United States Patent [19]

Sims et al.

[11] 3,957,837

[45] May 18, 1976

[54] METHIONAL-ANTIOXIDANT FOR POLYUNSATURATED OILS

[75] Inventors: Rex Junior Sims, Pleasantville; Joseph Anthony Fioriti, Hastings-on-Hudson, both of N.Y.

[73] Assignee: General Foods Corporation, White Plains, N.Y.

[22] Filed: Apr. 8, 1974

[21] Appl. No.: 458,945

[52] U.S. Cl. ..... 260/398.5; 426/547

[51] Int. Cl.[2] ..... C11B 5/00

[58] Field of Search ..... 260/398.5; 426/547

[56] References Cited

UNITED STATES PATENTS

| | | | |
|---|---|---|---|
| 2,397,960 | 4/1946 | Gribbins et al. | 426/547 |
| 2,523,127 | 9/1950 | Lundberg | 260/398.5 |
| 2,648,691 | 8/1953 | Thompson | 260/398.5 |
| 2,792,307 | 5/1957 | Chenicek | 426/547 |

OTHER PUBLICATIONS

"Chemicals Used in Food Processing", Publication 1274 National Research Council, Wash., D.C. (1965) p. 162.

*Primary Examiner*—Patrick P. Garvin

*Attorney, Agent, or Firm*—Thaddius J. Carvis; Daniel J. Donovan; Bruno P. Struzzi

[57] ABSTRACT

Methional, its dimer or trimer or a combination of these, is added to polyunsaturated oils in small but effective amounts to stabilize the oils against oxidative rancidity.

10 Claims, No Drawings

METHIONAL-ANTIOXIDANT FOR POLYUNSATURATED OILS

BACKGROUND OF THE INVENTION

There is increasing evidence that saturated fats in the diet elevate serum cholesterol levels and may be at least one factor responsible for the high incidence of heart disease in this country. Consequently, the food industry has been directing much effort to develop new products and modify existing products to incorporate higher relative levels of polyunsaturated fats. However, because of their different physical and chemical properties, many problems are encountered in formulating commercially acceptable products of this type.

One of the problems encountered is the poor storage stability of the high polyunsaturated fats and products containing them. They are highly susceptible to oxidative rancidity. Accordingly, they must be treated in some manner to decrease this tendency.

A number of chemical additives have been suggested as antioxidents for polyunsaturated oils. Among these are the synthetic phenolic antioxidants, the most effective of which is tertiarybutyl hydroquinone (TBHQ). Others are butylated hydroxyanisole (BHA) and butylated hydroxytoluene (BHT). These compounds are, however, regulated by the government, and the limited usage presently permitted is always subject to change.

Recently, several workers (Kawasaki-shi,H.E. et al. U.S. Pat. No. 3,585,223) tested the antioxidant capabilities of several amino acids; and, on the basis of peroxide values, determined that cystine was the best. Other workers (Fujimaki, et al.; Agri. Biol. Chem., Vol. 33, No. 8, p. 1144–1151; 1969) suggest that when the amino acid methionine was heated in oil, the degradation produce 3-methyl-thiopropylamine is useful as an antioxidant. There is, however, a continuing need to provide suitable alternatives to these materials with comparable or superior effectiveness.

SUMMARY OF THE INVENTION

It is an object to provide a polyunsaturated oil composition having increased resistance to oxidative rancidity.

It is a further object of the present invention to provide a method for increasing the resistance of polyunsaturated oils to oxidative rancidity.

These and other objects are accomplished according to the present invention which is based upon the discovery that adding from about 0.005% to about 0.5% by weight of methional, its dimer or trimer or any combination of these to a polyunsaturated oil will decrease the tendency of the oil toward oxidative rancidity.

DETAILED DESCRIPTION

The present invention encompasses the use of methional, its dimer or trimer or any combination of these on all polyunsaturated vegetable oils. Among the polyunsaturated vegetable oils are safflower oil, corn oil, soybean oil, rapeseed oil, cottonseed oil, peanut oil and sunflower oil. These oils can be used alone or in combination with other polyunsaturated or saturated oils.

For the purposes of the present invention, a polyunsaturated oil is defined as any vegetable oil, or vegetable oil blend, or combination thereof with an animal fat, having a ratio of polyunsaturated fat to saturated fat (P/S) of greater than about 0.8. The P/S is defined as the ratio of the total weight of essential fatty acids in the oil phase, as determined by Canadian Food and Drug Directorate Method FA59 December 1967), to the total weight of the saturated fats as measured by gas chromatography. The preferred gas chromatographic method employs a Perkin Elmer Model 900 gas chromatograph. The column is 6 feet × ⅛ inch OD filled with 12% DEGS on 70/80 mesh Anakrom ABS (Analabs, Inc.) or 12% EGSSX on 80/100 Gas Chrom P (Applied Science Labs, Inc.). The oven temperature is usually 200°C and the helium flow rate approximately 50 ml/minute. The methyl esters are prepared by a modified version of the Metcalfe procedure. Two drops (25–100 mg) of fat is placed in a 25 ml volumetric flask along with 4.0 ml 0.5N NaOH in MeOH and heated on the steambath until the fat globules dissolve (about 5 min.). Upon cooling 5.0 ml 14% $BF_3$ in MeOH is added and the mixture is heated gently for 25 minutes after which is added 10–15 ml saturated NaCl and 25 ml $CS_2$. The flask is stoppered, shaken vigorously for one minute and allowed to stand about five minutes to allow the layers to separate. From 1 to 3 $\mu$l of the organic layer is injected into the chromatograph. The peaks are quantified by electrical integration (Infotronics Model CRS-104).

Chemically, methional is defined by the structural formula:

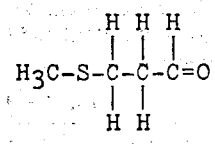

and by IUC nomenclature is 3-methylthio-propanal. It is an FDA approved GRAS flavoring material, the subject of FEMA No. 2747. It is readily soluble in oils and has a cabbage, potato or broth-like odor, depending on its level of usage.

Methional forms several polymer-like materials with aging. These can be fractionated from the mixtures with known techniques. One of these polymer-like materials, referred to as the dimer of methional, is the dehydrated aldol condensation product of methional and is represented by the formula:

$$CH_3—S—CH_2—C(CHO)=CH—(CH_2)_2—S—CH_3.$$

Another of these polymer-like materials, referred to as the trimer of methional, is represented by the formula:

$$(CH_3—S—CH_2—CHO)_3.$$

The use of methional, its dimer or trimer or any combination of these antioxidants are most desirable where their characteristic odors would not be incompatible with the particular end use of the oil. Thus, more suitable uses for oils stabilized in accordance with the present invention would include use in frying potatoes, salad oils and various snack items.

The methional, its dimer or trimer or any combination of these is added to the oil by simple mixing in amounts of from about 0.005% to about 0.5%. More preferably, it is added in amounts of from about 0.01% to 0.1%, and most preferably, at a level of from about 0.025% to about 0.075%. In a preferred embodiment of the present invention, it is added at any of the above indicated levels, e.g. about 0.05% to a polyunsaturated oil to provide a composition consisting essentially of the oil and methional, its dimer or trimer or any combination of these.

Commercial samples of methional, even those sold as chemically pure are usually a mixture of methional with its dimer and trimer as defined above. One commercial sample, after aging for about 2 years had the following composition:

67% methional
6% dimer
28% trimer

A sample with this composition is employed in the following examples unless otherwise indicated.

The following examples are presented for the purpose of further describing and explaining the present invention and are not to be taken as limiting in any regard. Unless otherwise indicated, all parts and percentages are by weight.

EXAMPLE I

A two year old sample of methional (C.P.), having the composition noted previously, was added to safflower oil at levels of 0.5% and 0.1%, and tested against a safflower oil control for its ability to inhibit oxygen absorption and the development of hydroperoxides at 60°C. Since safflower oil is one of the most difficult of the vegetable oils to stabilize, results shown here should be valid for other oils such as cottonseed and corn. The level of oxygen in the headspace gas was measured at 60°C. The level of hydroperoxides was also followed by the AOCS Official Method Cd 8-53. The results are summarized in Table I.

TABLE I

| TIME (Days) | CP METHIONAL (METHIONAL-DIMER-TRIMER COMBINATION) 0% | | 0.5% | | 0.1% | |
|---|---|---|---|---|---|---|
| | Vol% $O_2$ | PV | Vol.% $O_2$ | PV | Vol.% $O_2$ | PV |
| 0 | 20.97 | 1.2 | 20.97 | 1.2 | 20.97 | 1.2 |
| 1 | 20.97 | 5.2 | 20.85 | 1.2 | 20.82 | 0.8 |
| 2 | 19.18 | 11.3 | 20.81 | 1.0 | 20.76 | 0.3 |
| 3 | 18.23 | 17.3 | 20.62 | 0.8 | 20.64 | 0.2 |
| 4 | 16.97 | 23.3 | 20.57 | 0.7 | 20.49 | 0.2 |
| 7 | 11.83 | 36.6 | 20.25 | 0.4 | 20.11 | 0.0 |
| 9 | 1.62 | 49.0 | 20.10 | 0.6 | 20.02 | 0.2 |

EXAMPLE II

The procedure of Example I was repeated but this time the methional-dimer-trimer combination was employed at levels of 0.05%, 0.02% and 0.005% and tested against a control of safflower oil with no additives and a safflower oil control with 0.02% TBHQ, its maximum permitted level of use. The results are summarized in Table II.

TABLE II

| TIME (Days) | % METHIONAL-DIMER-TRIMER 0 | | 0.05 | | 0.02 | | 0.005 | | % TBHQ 0.02 | |
|---|---|---|---|---|---|---|---|---|---|---|
| | %$O_2$ | PV | %$O_2$ | PV | %$O_2$ | PV | %$O_2$ | PV | %$O_2$ | PV |
| 0 | 20.97 | 1.2 | 20.97 | 1.2 | 20.97 | 1.2 | 20.97 | 1.2 | 20.97 | 1.2 |
| 1 | 20.71 | 4.7 | 20.92 | 1.7 | 20.91 | 2.2 | 20.81 | 2.9 | 20.91 | 2.0 |
| 2 | 20.21 | 10.4 | 10.84 | 1.4 | * | 2.2 | 20.61 | 3.0 | 20.81 | 3.0 |
| 5 | 17.79 | 24.0 | 20.51 | 1.0 | * | 1.8 | 19.16 | 15.6 | 20.46 | 4.8 |
| 7 | 15.86 | 32.2 | 20.38 | 0.9 | * | 2.1 | 17.71 | 23.8 | 20.24 | 6.2 |

*Samples not evaluated because stoppers were displaced and headspace gas was lost.

EXAMPLE III

A shelf stable product according to the present invention is prepared having the following composition on a dry basis:

| Ingredient | Parts |
|---|---|
| safflower oil | 25 |
| Mor-Sweet 1435 high maltose corn syrup | 69 |
| sodium caseinate | 5 |
| Myverol SMG succinoylated monoglycerides** | 1 |
| Methional-dimer-trimer combination | 0.025 |

**The succinoylated monoglycerides are neutralized to pH 7 with $Na_2CO_3$ prior to preparation.

The sodium caseinate, the Mor-Sweet corn syrup, and the neutralized succinoylated monoglycerides are mixed in the indicated amounts with about 235 parts water and blended at about 60°C. The resulting blend is then added to the safflower oil containing the methional-dimer-trimer combination at about 60°C and emulsified by whipping at high speed in a Waring Blender for about 5 minutes. The resulting emulsion is then spray-dried to form a white powder which was relatively non-sweet and suitable for use in a packaged dry salad dressing mix.

EXAMPLE IV

A series of dry emulsions was prepared by spray drying emulsions having the following compositions and including therein the amounts (based on weight of fat) of antioxidants specified in Table III:

| | |
|---|---|
| water | 200 ml |
| Mor-Sweet 1435 corn syrup | 241g |
| safflower oil | 90g |
| SMG succinoylated monoglycerides | 9g |
| $Na_2CO_3$ | 0.9g |

Storage for the indicated times at 60°C gave the %$O_2$, peroxide values (PV), and organoleptic (org.) evaluation indicated in Table III.

TABLE III

| Time (Days) | None %$O_2$ | None PV | None Org. | 0.06% TBHQ %$O_2$ | 0.06% TBHQ PV | 0.06% TBHQ Org. | 0.3% methionine %$O_2$ | 0.3% methionine PV | 0.3% methionine Org. |
|---|---|---|---|---|---|---|---|---|---|
| 0 | 20.98 | — | — | 20.98 | — | — | 20.98 | — | — |
| 1 | 19.93 | — | sl. rancid | 20.67 | — | clean | 19.96 | — | Potato |
| 2 | 17.11 | 147.4 | rancid | 20.21 | 14.3 | clean | 18.39 | 66.7 | off |
| 3 | 1.74 | 76.8 | rancid | 19.80 | 98.0 | rancid | 1.73 | 310 | rancid |
| 5 | — | — | — | — | — | — | — | — | — |
| 6 | — | — | — | 1.85 | — | rancid | — | — | — |
| 8 | — | — | — | — | — | — | — | — | — |

| Time (Days) | 0.1% methional-dimer-timer %$O_2$ | PV | Org. | 0.3% Cystine %$O_2$ | PV | Org. | 0.3% Cysteine %$O_2$ | PV | Org. |
|---|---|---|---|---|---|---|---|---|---|
| 0 | 20.98 | — | — | 20.98 | — | — | 20.98 | — | — |
| 1 | 20.58 | — | Potato | 20.57 | — | sulfur | 20.42 | — | sulfur |
| 2 | 20.06 | 8.7 | meat-like | 19.95 | 25.1 | sulfur | 19.70 | 30.6 | sulfur |
| 3 | 19.56 | 13.5 | meat-like | — | — | — | — | — | — |
| 5 | — | — | — | 1.67 | 65.4 | rancid | 16.75 | — | rancid |
| 6 | 18.29 | 65.4 | rancid | — | — | — | — | — | — |
| 8 | 16.97 | — | — | — | — | — | 1.71 | — | — |

EXAMPLE V

The procedure of Example I was repeated, but this time evaluating only for %$O_2$ and employing a control comprising 0.1% cystine, and comparing thereto (a) 99% pure methional at 0.005% and 0.01%, (b) a dimer rich fraction containing 15% methional and 85% dimer at 0.005% and 0.01%, and (c) a trimer rich fraction containing 73% trimer and the remainder unknown polymeric material at 0.005% and 0.01%. The results are summarized in Table IV.

TABLE IV

| TIME (Days) | CYSTINE 0.1 | 99% PURE METHIONAL 0.005 | 99% PURE METHIONAL 0.01 | DIMER RICH 0.005 | DIMER RICH 0.01 | TRIMER RICH 0.005 | TRIMER RICH 0.01 |
|---|---|---|---|---|---|---|---|
| 2 | 19.58 | 20.30 | 20.49 | 19.23 | 20.43 | 19.83 | 20.33 |
| 3 | 18.68 | 19.84 | 20.20 | 18.45 | 20.22 | 19.18 | 19.69 |
| 4 | 17.68 | 19.36 | 19.92 | 17.64 | 20.17 | 18.26 | 19.02 |
| 5 | 16.60 | 18.72 | 19.62 | 16.72 | 19.70 | 17.25 | 18.15 |
| 6 | 15.46 | 18.04 | 19.30 | 15.57 | 19.48 | 16.29 | 17.00 |
| 10 | 1.90 | 1.73 | 16.71 | 1.73 | 17.84 | 2.37 | 9.58 |

Many modifications and variations of the present invention will be apparent to those skilled in the art upon reading the above disclosure. It is intended that all such modifications and variations be included within the scope of the invention which is defined by the following claims:

What is claimed is:

1. A stabilized polyunsaturated oil composition comprising a polyunsaturated oil and from about 0.005% to about 0.5% by weight of methional, its dimer, trimer or any combination of these based on the weight of the oil.

2. A composition according to claim 1 wherein the methional, its dimer, trimer or a combination of these, is present at a level of from about 0.01% to about 0.1%.

3. A composition according to claim 1 wherein the methional, its dimer, trimer or combination of these, is present at a level of from about 0.025% to about 0.075%.

4. A composition according to claim 1 wherein the composition consists essentially of the polyunsaturated oil and the methional, its dimer, trimer or any combination of these.

5. A composition according to claim 4 wherein the methional, its dimer, trimer or combination of these, is present at a level of from about 0.01% to about 0.1%.

6. A composition according to claim 5 wherein the methional, its dimer, trimer or combination of these, is present at a level of from about 0.025% to about 0.075%.

7. A method for increasing the stability of a polyunsaturated oil to oxidative rancidity which comprises adding methional, its dimer, trimer or any combination of these, to the oil at a level of from about 0.005% to about 0.05% based on the weight of the oil.

8. A method for increasing the stability of a composition consisting essentially of a polyunsaturated oil to oxidative rancidity which comprises adding methional, its dimer, trimer or any combination of these, to the oil at a level of from about 0.005% to about 0.05% based on the weight of the oil.

9. A method for increasing the stability of a composition consisting essentially of a polyunsaturated oil to oxidative rancidity which consists essentially of adding methional, its dimer, trimer or any combination of these, to the oil at a level of from about 0.005% to about 0.5% based on the weight of the oil.

10. A method according to claim 9 wherein the methional, its dimer, trimer or combination of these, is added at a level of from about 0.025% to about 0.075%.

* * * * *